US006743028B2

(12) United States Patent
Wang

(10) Patent No.: US 6,743,028 B2
(45) Date of Patent: Jun. 1, 2004

(54) ELECTRICAL CONNECTOR FOR ATTACHING A CIRCUIT BOARD

(75) Inventor: Mei-Hui Wang, Hsinchu (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/244,073

(22) Filed: Sep. 16, 2002

(65) Prior Publication Data

US 2004/0053522 A1 Mar. 18, 2004

(51) Int. Cl.[7] ..... H01R 4/66
(52) U.S. Cl. ..... 439/92; 439/328
(58) Field of Search ..... 439/328, 325, 439/327, 357, 374, 650, 92

(56) References Cited

U.S. PATENT DOCUMENTS 6,030,245 A * 2/2000 Choy ..... 439/328
6,231,364 B1 * 5/2001 Liu ..... 439/326
6,464,514 B1 * 10/2002 Tsai et al. ..... 439/92
2002/0072263 A1 * 6/2002 Fumikura ..... 439/327

* cited by examiner

*Primary Examiner*—Anthony Dinkins
*Assistant Examiner*—Jinhee Lee
(74) *Attorney, Agent, or Firm*—Birch, Stewart, Kolasch & Birch, LLP

(57) ABSTRACT

A structure of a connector for attaching a circuit board is disclosed. The connector includes a housing composed of an insulation material, a socket and two buckling elements detachably attached to two ends of the socket. The socket includes a groove in a central region for receiving a circuit board, and a row of signal contacts within the groove for attaching and electrically connecting with the circuit board. At two ends of the groove are two buckling arms. The circuit board inserted into the groove and pressed in between the buckling arms, and making the contact points of the circuit board to come in electrical contact with signal contacts inside of groove of the socket.

6 Claims, 9 Drawing Sheets

ELECTRICAL CONNECTOR FOR ATTACHING A CIRCUIT BOARD

BACKGROUND OF THE INVENTION

1. Filed of the Invention

The present invention relates to an electrical connector, and more particularly to an electrical connector having resilient arms for securely buckling a circuit board, electrically connecting with the circuit board, and preventing the circuit board from coming loose.

2. Description of the Related Art

Due to the rapid advancement in computer and information technologies, nowadays desktop and notebook computers are very popular. Further, the need for smaller, thinner and compact, and faster electronic devices are greatly demanded in the present market. Electrical connectors are connected to a variety of circuit board, for example a memory chip module, for saving, transmitting and/or retrieving electronic data signals.

Referring to FIGS. 8, 9 and 10, show a structure of a thin conventional electrical connector comprising a socket B for inserting a memory chip module A of a interface card for saving, retrieving, transmitting the electronic data randomly or for extending the memory. When the memory chip module A is obliquely pushed into the inner groove B1 of the socket B, the inner groove B1 is used as an axis to press the memory chip module A downwardly (as shown in FIG. 9), as a result, the edge of memory chip module A directly presses against the buckling block B21 which is positioned on a inner side of the suspending arms B2 attached to two sides of the socket B (as shown in FIG. 10), to securely buckle the edge of the memory chip module A buckling to the base side surface of buckling block B21. Although this design can buckle the memory chip module A, however as the memory chip module A is forced in between the suspending arms B2, the suspending arms B2 presses against the sides of the memory chip module A due the inertial property and the plastic material which causes the suspending arms B2 to bend inwardly, while a bottom face of memory chip module A directly presses against the buckling block B21. Accordingly, the space available for memory chip module A to buckle on to buckling block B21 of suspending arm B2 is small and therefore the fitting of the memory chip module A between the two suspending arms B2 is poor. When the memory chip module A is shaken due to some external force, for example during maintenance, the memory chip module A will easily come loose and gets disconnected from the socket B.

Further, when the size of the buckling block B21 of the suspending arms B2 of socket B is enlarged in an attempt to secure buckling of the memory chip module A, as the memory chip module A is pressed downwardly against the buckling block B21, the two suspending arms B2 will be forced outwardly or downwardly causing fracture or even break the suspending arms B2.

SUMMARY OF THE INVENTION

Accordingly, in the view of the foregoing, the present inventor makes a detailed study of related art to evaluate and consider, and uses years of accumulated experience in this field, and through several experiments, to create a new electrical connector of the present invention for attaching a circuit board. The present invention provides an innovated electrical connector for firmly fastening or releasing a circuit board, which can effectively prevent the circuit board from coming loose and disconnected from the electrical connector by an unwanted external force.

Accordingly, an object of the present invention is to provide an electrical connector having two resilient arms with sufficient buckling space for securely buckling a circuit board.

Another object of the present invention is to provide an electrical connector having two resilient arms with sufficient buckling space for securely buckling a circuit board and to provide a proper electrical connection between the electrical connector and the circuit board.

Another object of the present invention is to provide an electrical connector having two resilient arms with sufficient buckling space for securely buckling a circuit board and effectively preventing the circuit board from coming loose and disconnected from the electrical connector by an unwanted external force.

In order achieve the above objects and other advantages of the present invention, a connector for attaching a circuit board of the present invention comprises a housing composed of an insulation material, a socket and two buckling arms detachably attached to two ends of the socket. The socket comprises a groove in a central region for receiving a circuit board, for example, a memory chip module, and a row of signal contacts within the groove for attaching and electrically connecting with the memory chip module. At two ends of the groove comprise two buckling elements. Each of the buckling arms comprises a buckling groove. Each of the buckling arms comprises an insertion portion for engaging with each of the buckling groove of the socket, and a plurality of gears disposed at a bottom edge of insertion portion. A resilient arm and a base plate extend along the same direction from the insertion portion. The resilient arm comprises an arch-shaped structure biasing inwardly on a side and a securing element extended downwardly. A pad clamps inwardly around two sides of the securing element. A distal end of the base plate comprises a positioning element folded inwardly. A lower edge of the base plate comprises a welding portion bent inwardly fitted with a covering element and to form a gap therewithin.

The circuit board comprises an indentation portion on the two sides for engaging with the pad of the securing element of the buckling arm. A plurality of contact points are disposed on a frontal end of the circuit board wherein each of the contact points is disposed on a top side, bent to extend on a sidewall and bent to extend on a bottom side of the connecting side. The frontal end of the circuit board is inserted into the groove of the slot to make an electrical contact with the row of signal contacts for electronic signal transmission.

According to an aspect of the present invention the circuit board is inserted into the groove and pressed on to arch-shaped area. The insertion portion of the buckling arm are inserted into the buckling grooves of the socket and securely positioned with the gears securing the buckling arm within the buckling grooves and preventing the insertion portion from slipping out. The frontal end of the circuit board is obliquely inserted into the groove of the socket so that the contact elements of the circuit board comes in contact with the row of signal contacts of the socket. Then, using the groove as an axis, the circuit board is pressed downwardly, as a result, the edge of the circuit board is pressed against the arch-shaped area of resilient arm pushing the resilient arms on a side outwardly and the circuit board is inserted between the side of base and positioning element. The side of base secures the circuit board by pressing against the sides of the circuit board. This condition does not break or make the resilient arms lose its elasticity, the elastic property of the resilient arms allows itself to be deformed and extend on a side outwardly as the circuit board is pushed over the arch-shaped area enabling the pad of resilient arm bent around the securing element for securely buckling the indention portion of the circuit board. In this condition, the securing element is positioned against positioning element of the base plate, and making the contact elements of the circuit board to come in electrical contact with signal contacts inside of groove of the socket.

According to another aspect of the present invention the space between the side of base plate and positioning element allows the side of base flexibly extend on the side outwardly without the risk of breaking or loss of elasticity when the circuit board is pressed in between the resilient arms.

According to another aspect of the present invention, the space is formed between the side of base plate and positioning element allows the side of base flexibly extend on the side outwardly without the risk of breaking or loss of elasticity and allows the pad of resilient arm which is clamped around the securing element to buckle the indention portion of the circuit board, and the securing element can be against the positioning element of the base plate, to substantially secure the circuit board and preventing the circuit board from coming loose.

According to another aspect of the present invention the welding portion which is bent inwardly at the down side of the base plate of the buckling arm, and a covering element covering the welding portion forms a gap. The welding portion together with the covering element limits the upward and downward movement of the circuit board when the circuit board is inserted into the groove of the socket and secured in between the resilient arms. The circuit board can be maintained at a horizontal position with respect to the socket to assure proper electrical connection between the signal contacts of the socket and the contact elements of the circuit board.

According to another aspect of the present invention the welding portion together with the covering element renders the support for the circuit board strong and therefore they do not easy to break under the insertion pressure of the circuit board.

DESCRIPTION OF THE PREFERRED EMBODIMENTS

Figure 1:
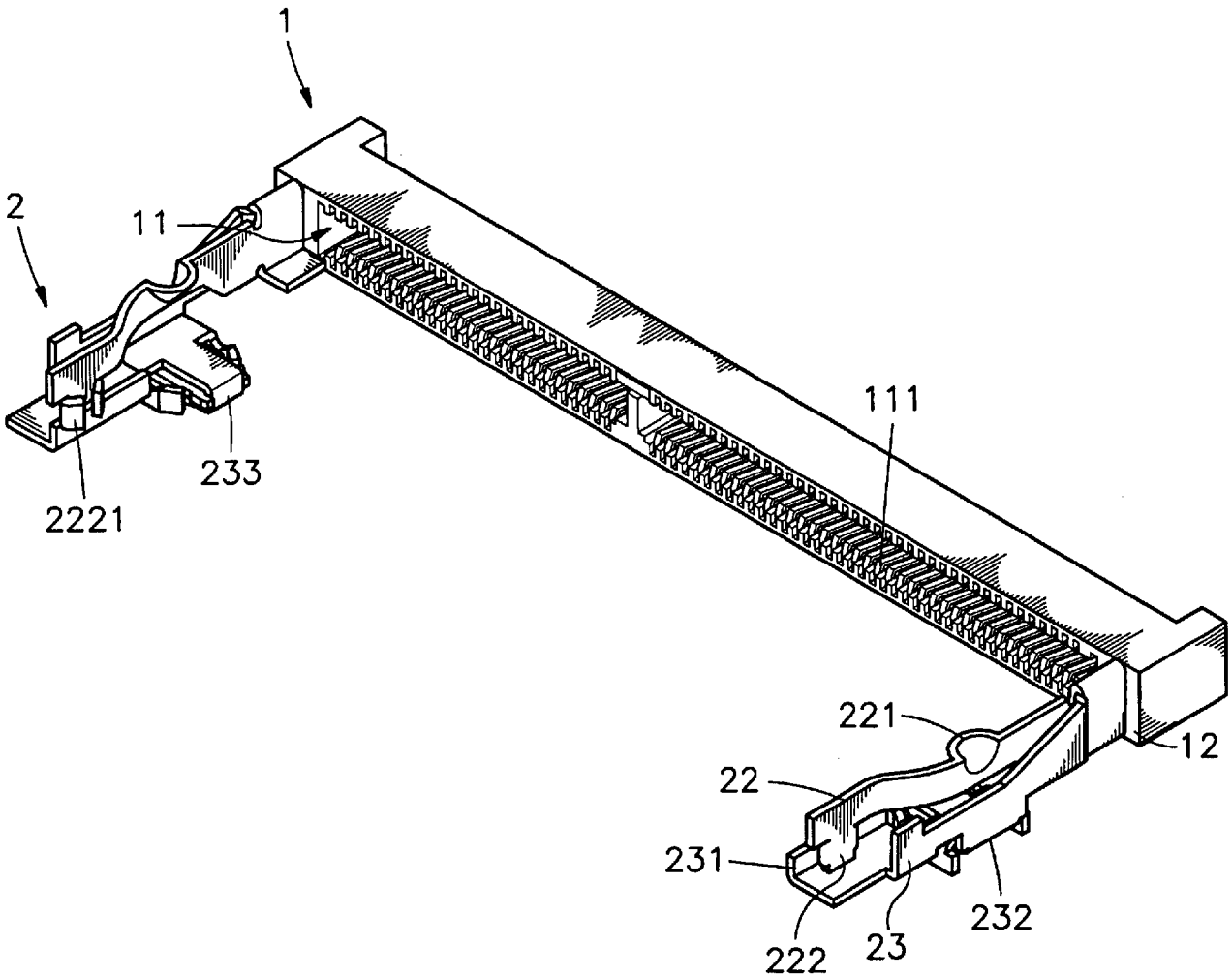
FIG. 1 is an elevational view of an electrical connector for attaching a circuit board according to the present invention.

Reference will be made in detail to the preferred embodiments of the invention, examples of which are illustrated in the accompanying drawings. Wherever possible, the same reference numbers are used in the drawings and the description to refer to the same or like parts.

Referring to FIGS. 1, 2, 3 and 4, a connector for attaching a circuit of the present invention comprises a housing composed of an insulation material, a socket 1 and two buckling arms 2 detachably attached to two ends of the socket 1.

The socket 1 comprises a groove 11 in a central region for receiving a circuit board 3, for example, a memory chip module, and a row of signal contacts 111 within the groove 11 for attaching and electrically connecting with the circuit board 3. At two ends of the socket 1 comprise two buckling elements 12. Each of the buckling elements 12 comprises a buckling groove 121 on a groove side and positioned adjacent to the groove 11. The socket 1 is constructed from a insulation material.

Each of the buckling arms 2 comprises an insertion portion 21 for engaging with each of the buckling groove 121 of the socket 1, a plurality of gears 211 disposed at a bottom edge of the insertion portion 21. A resilient arm 22 and a base plate 23 extend along the same direction from the insertion portion 21. The resilient arm 22 comprises an arch-shaped structure biasing inwardly on a side and a securing element 222 extending downwardly. The securing element 222 comprises a pad 2221 clamps inwardly around two sides of the securing element 222. A distal end of the base plate 23 comprises a positioning element 231 folded inwardly. A lower edge of the base plate 23 comprises a welding portion 232 bent inwardly fitted with a covering element 233 and to form a gap therewithin. The buckling arms 2 are constructed from a conductive material.

The circuit board 3, for example, a memory chip module, comprises an indentation portion 31 on the two sides for engaging with the securing element 222 of the buckling arm 2. A plurality of contact elements 32 are disposed on a frontal end of the circuit board 3 wherein each of the contact elements 32 is disposed on a top side, bent to extend on a sidewall and bent to extend on a bottom side of the connecting side. The frontal end of the circuit board 3 is inserted into the groove 11 of the socket 1 to make an electrical contact with the row of signal contacts 111 for electronic signal transmission.

Figure 2:
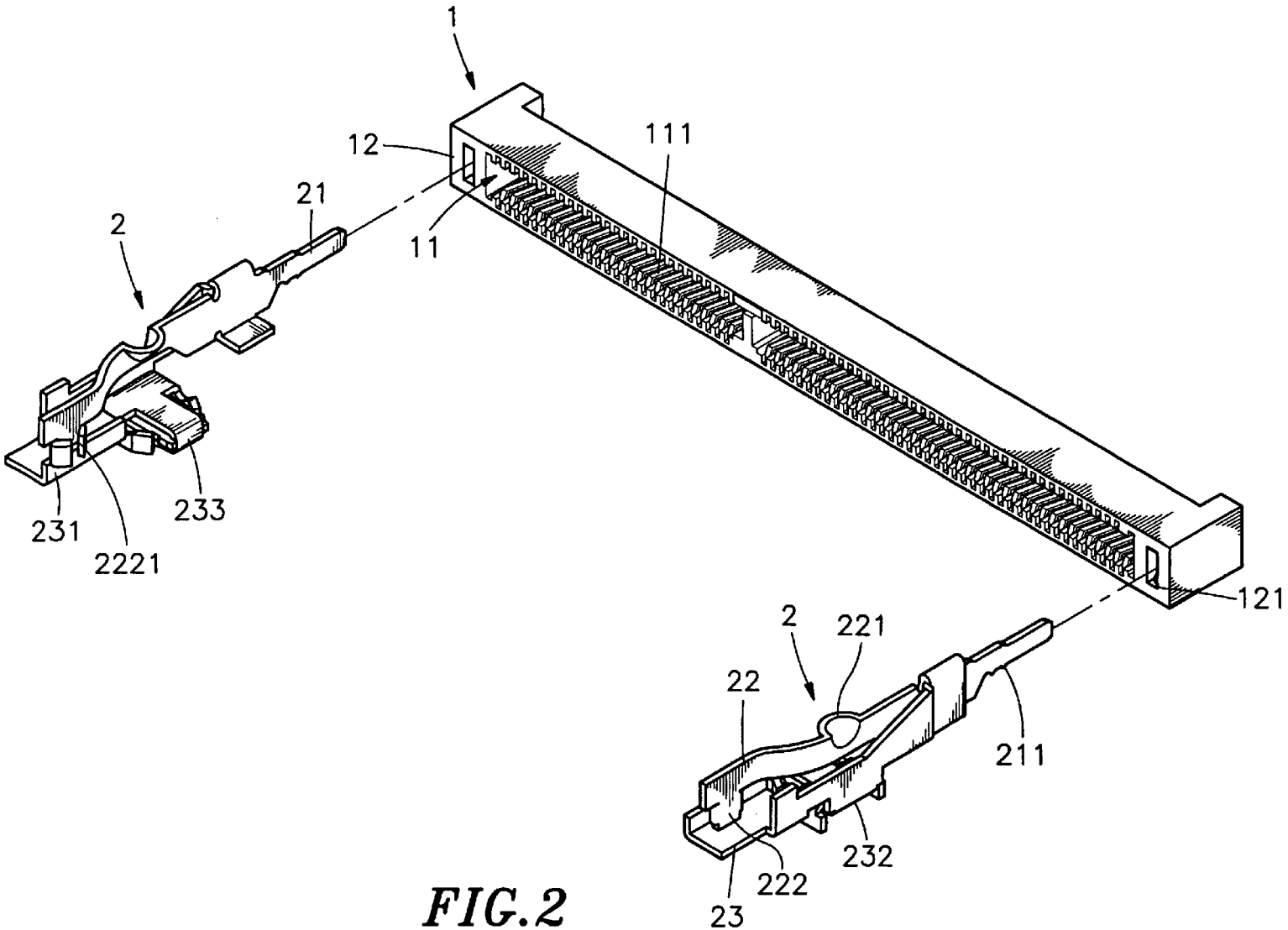
FIG. 2 is an exploded view of FIG. 1.
Figure 3:
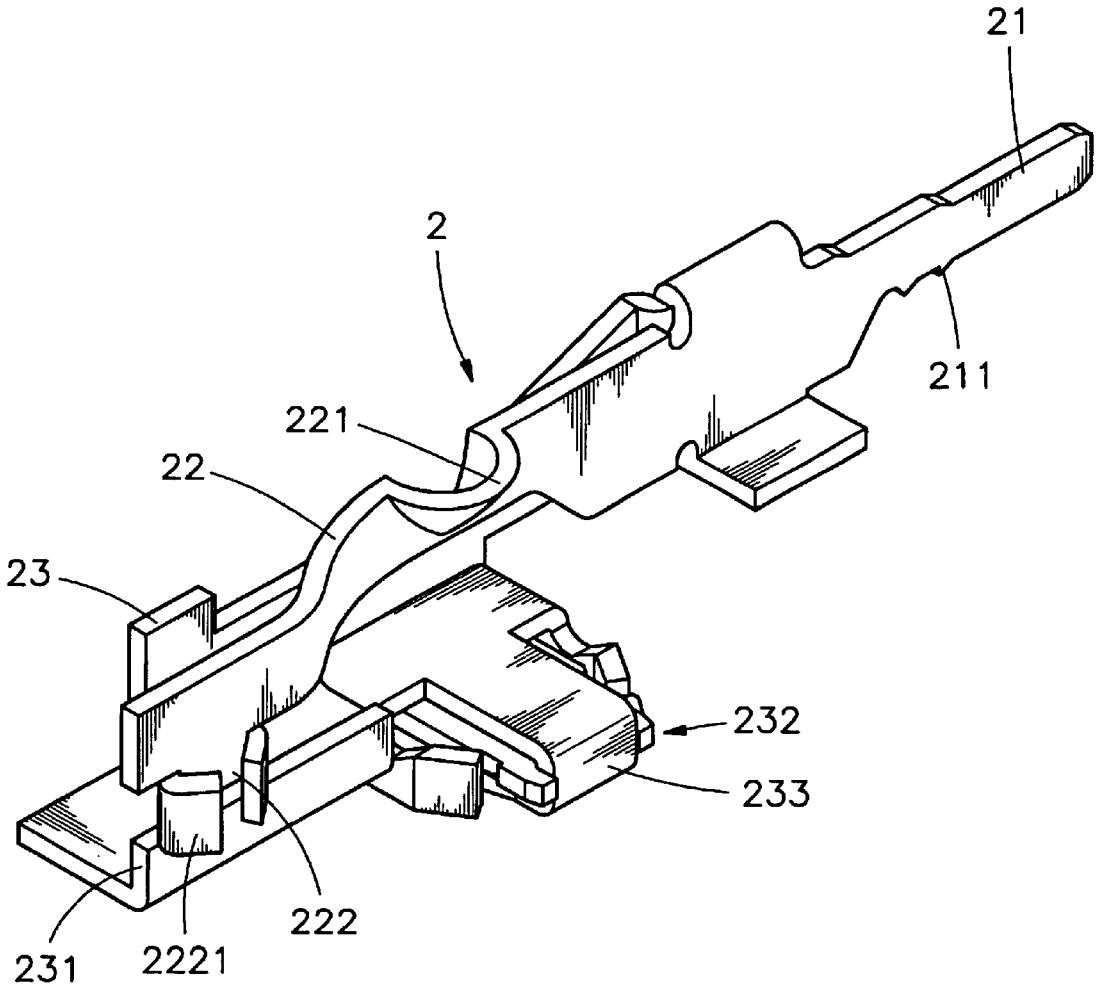
FIG. 3 is an elevational view of an buckling arm according to the present invention.
Figure 4:
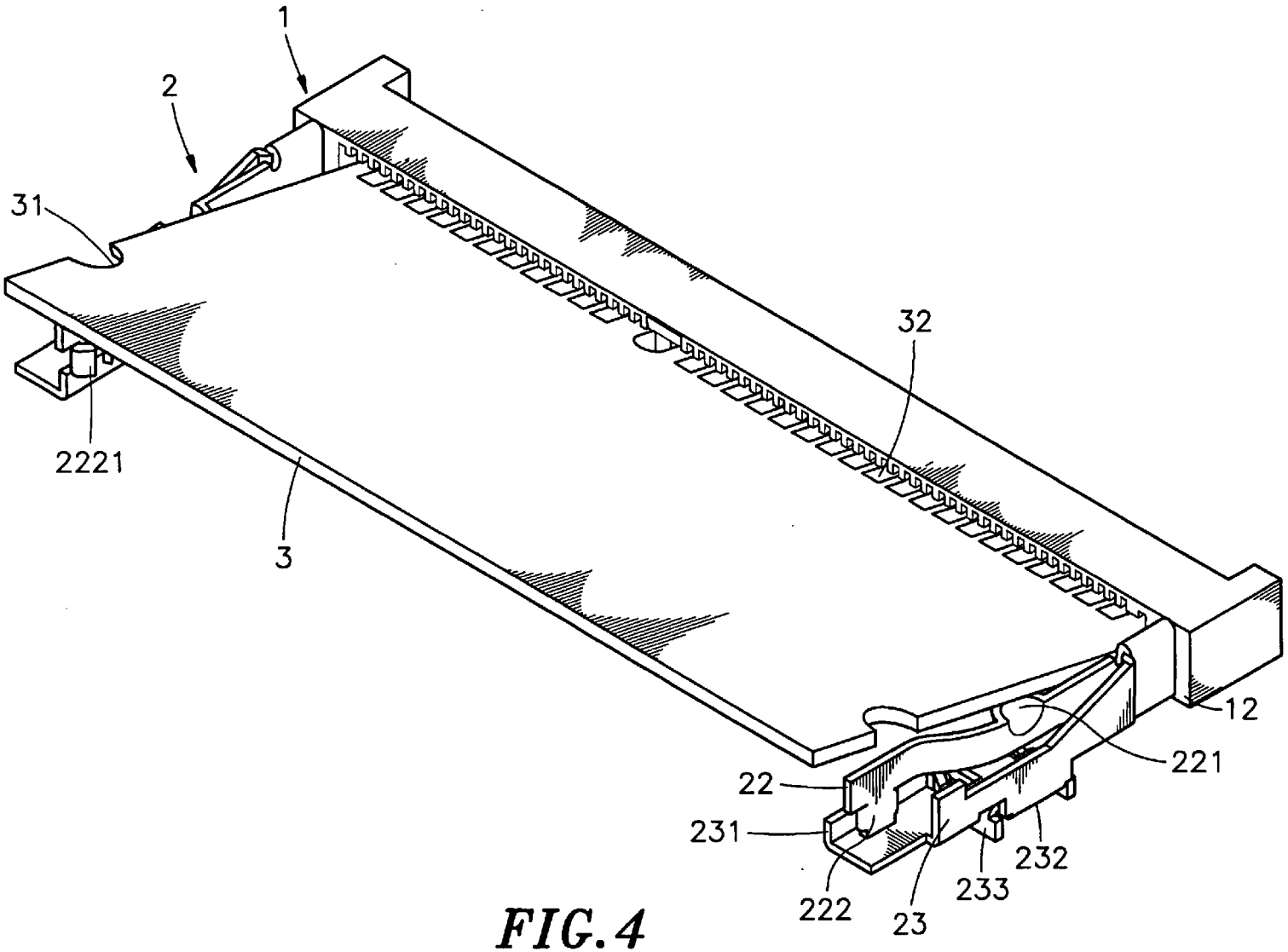
FIG. 4 is an elevational view showing insertion of the circuit board into the groove of the socket of the electrical connector according to the present invention.
Figure 5:
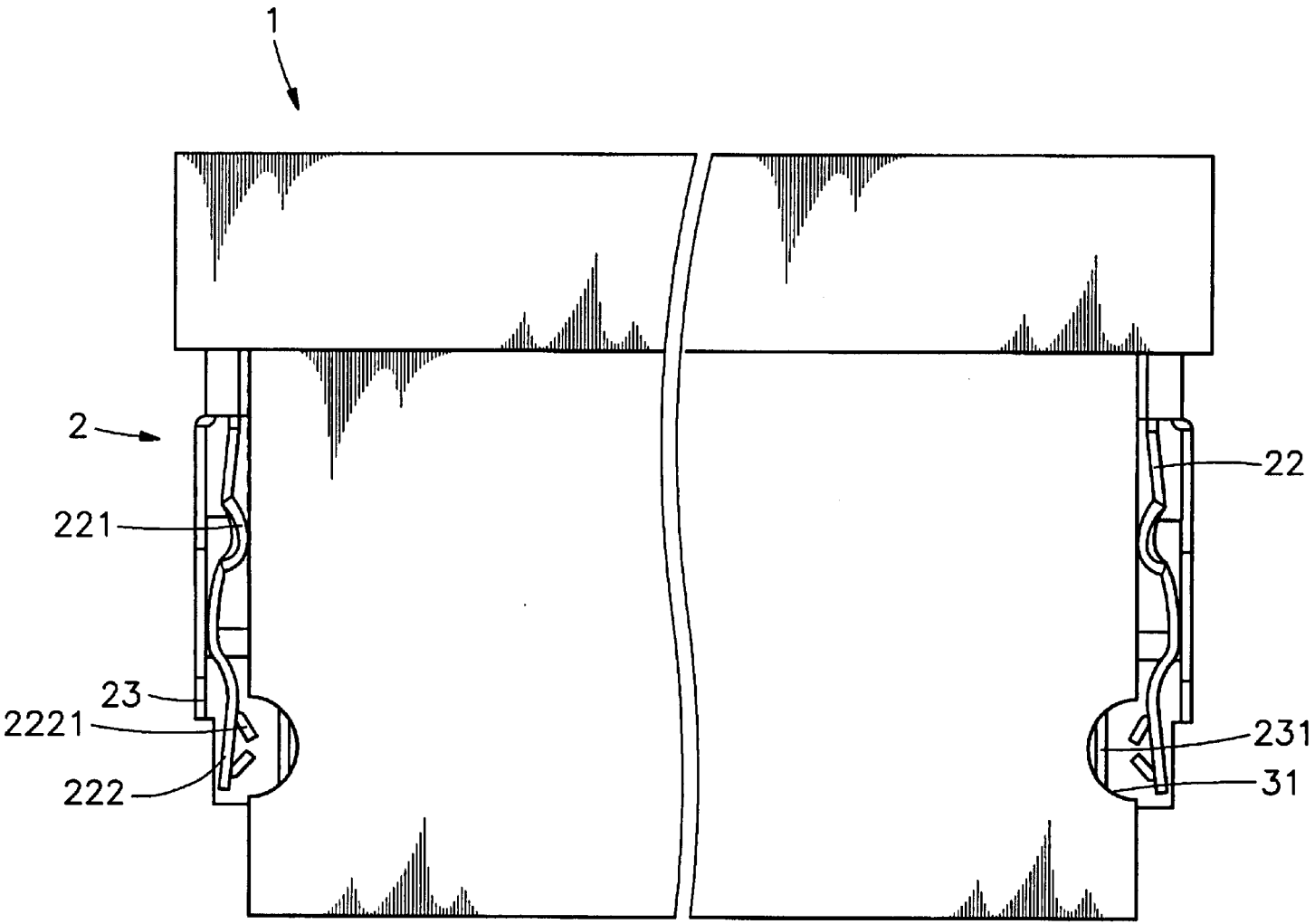
FIG. 5 is a top view showing the circuit board being pressed downward on to the arch-shaped structure the buckling arm according to the present invention.
Figure 6:
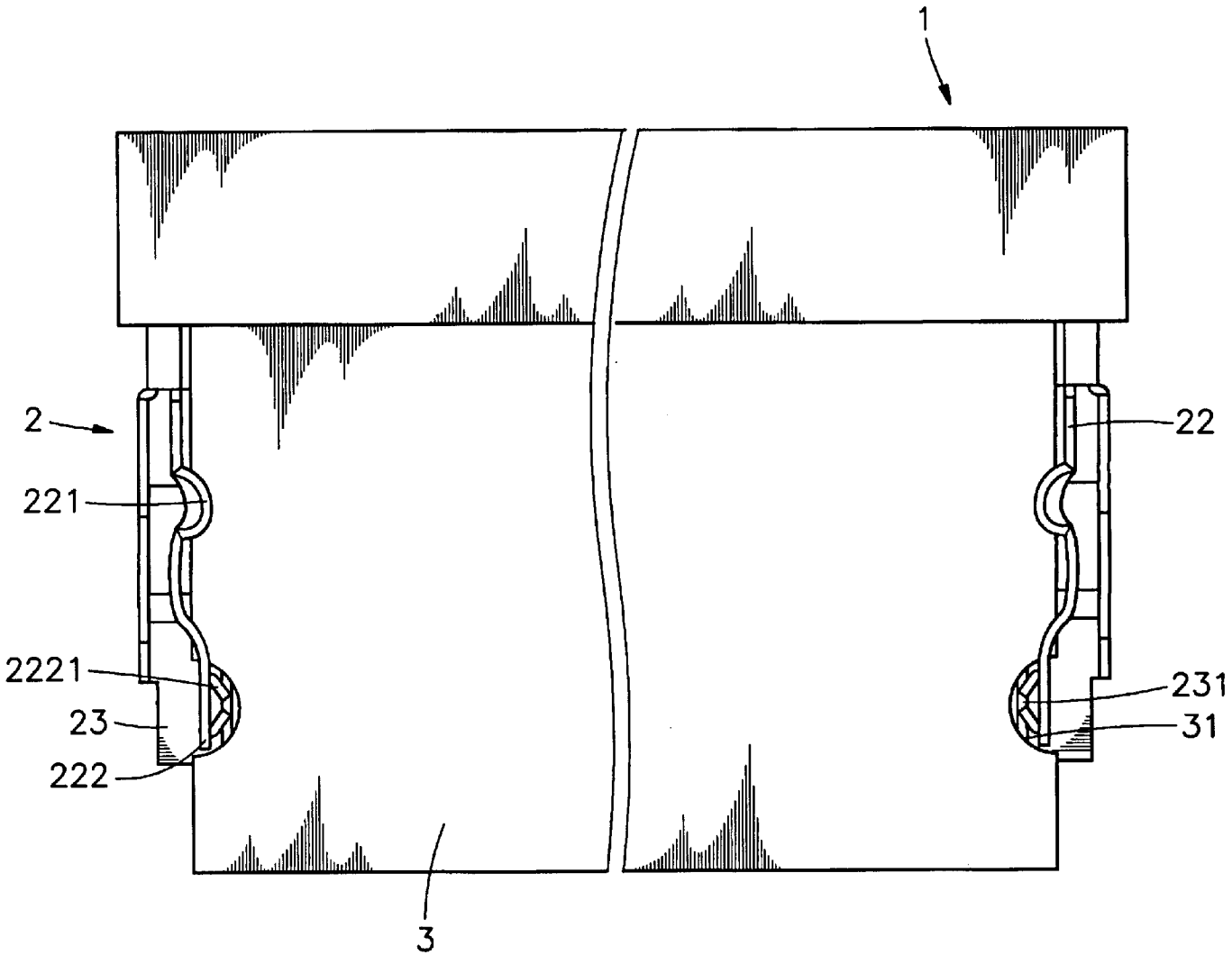
FIG. 6 is a top view showing the electrical connector after assembling the circuit board therewithin according to the present invention.
Figure 7:
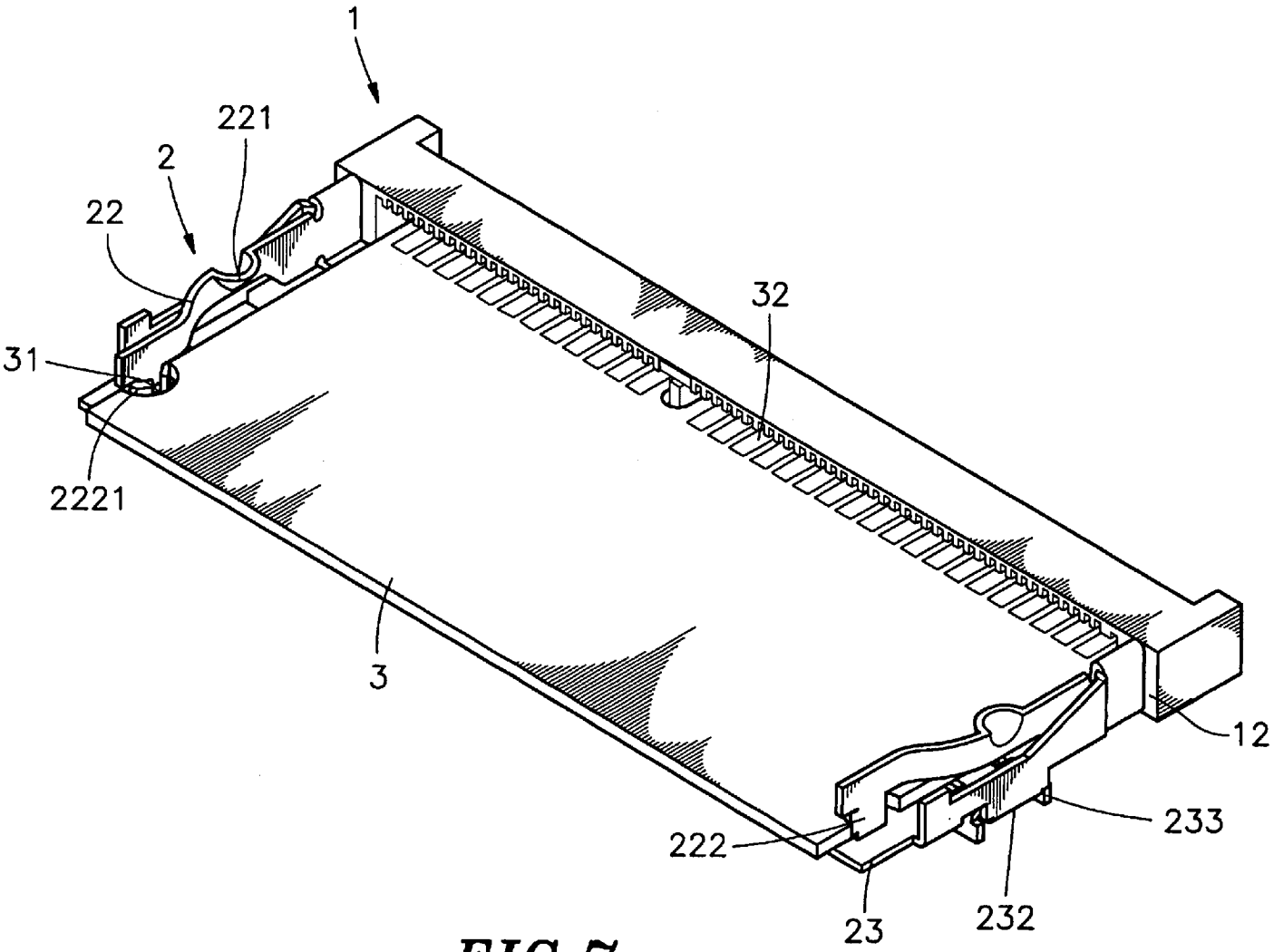
FIG. 7 is an elevational view showing the electrical connector after assembling the circuit board therewithin according to the present invention.
Figure 8:
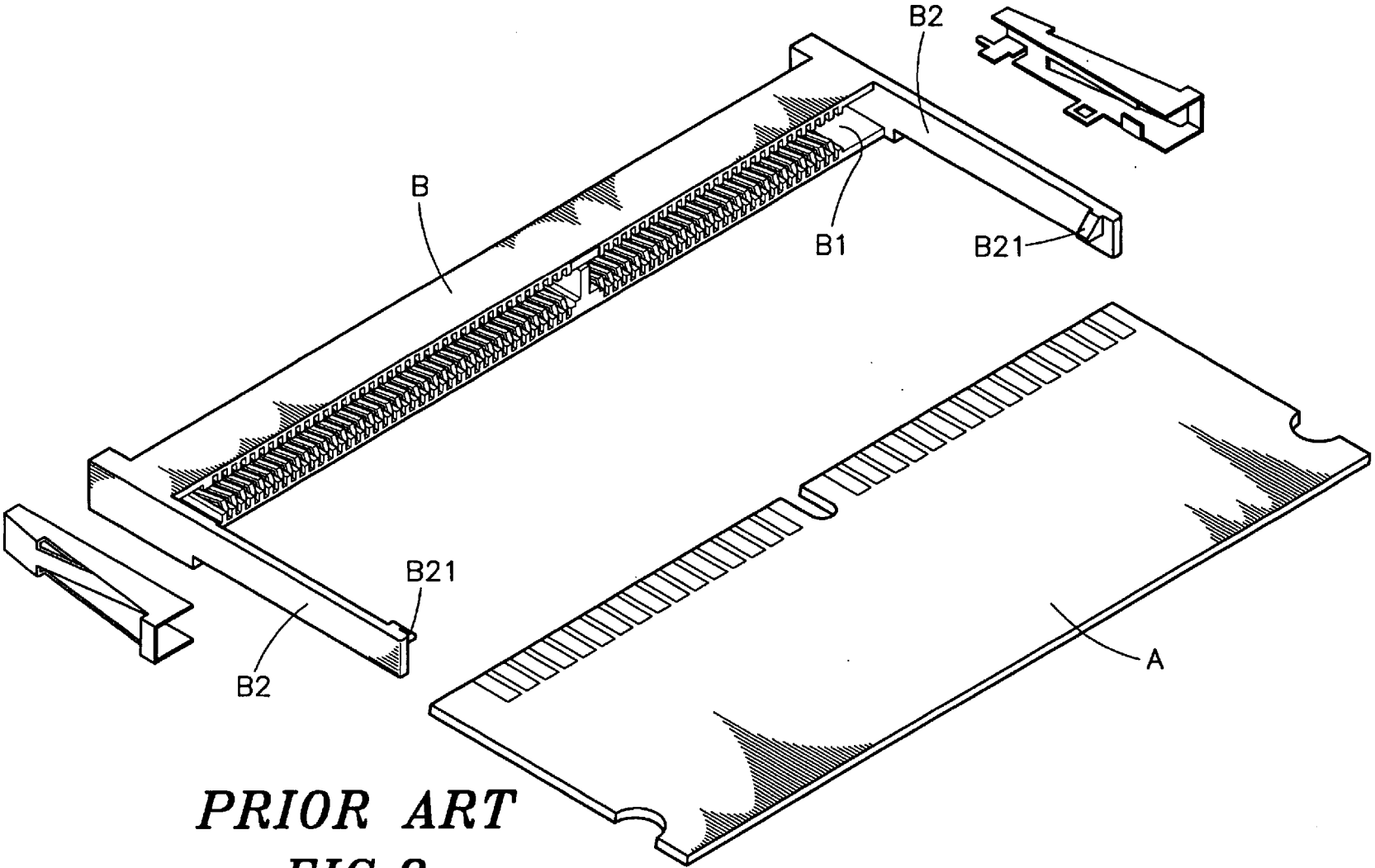
PRIOR ART FIG.8
FIG. 8 is an exploded view of an electrical connector according to a conventional art.
Figure 9:
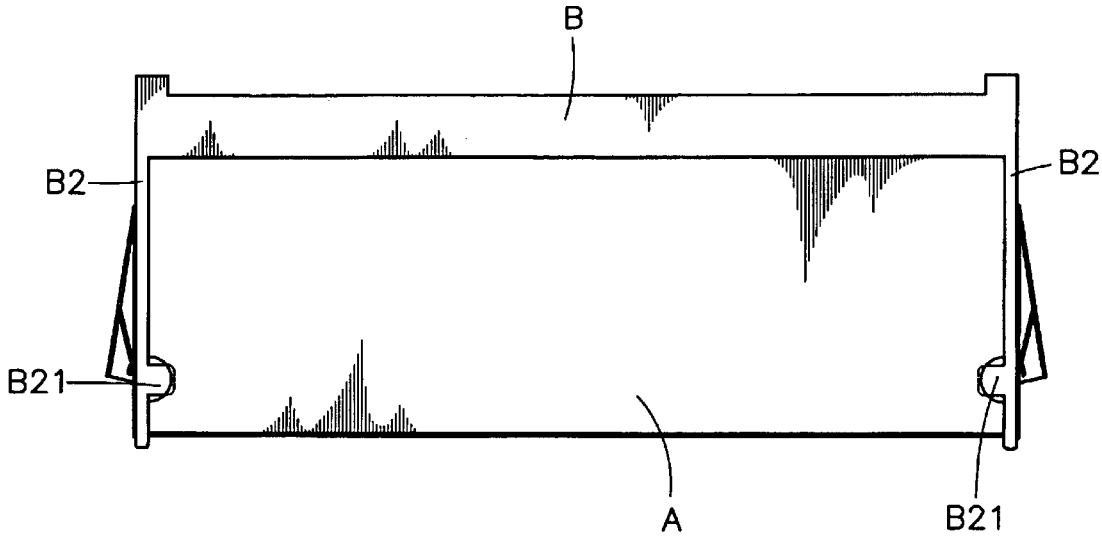
PRIOR ART FIG. 9
FIG. 9 is a top view showing the electrical connector before the insertion of the circuit board securely on to the buckling block of the conventional electrical connector.
Figure 10:
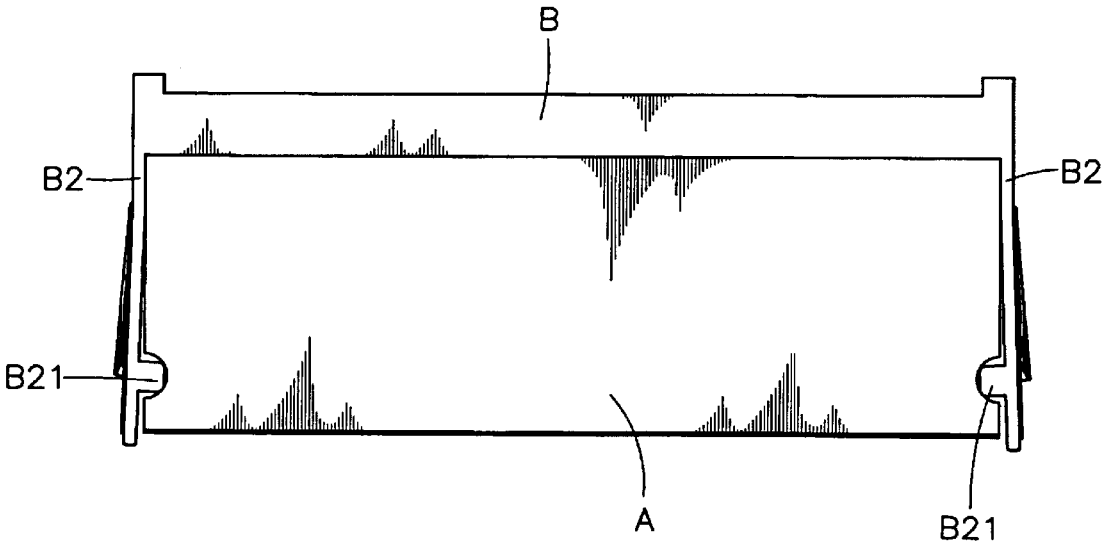
PRIOR ART FIG. 10
FIG. 10 is a top view showing the electrical connector after the insertion of the circuit board securely on to the buckling block of the conventional electrical connector.

Referring to FIGS. 4, 5, 6 and 7, show the circuit board 3 inserted into the groove 11 and pressed on to arch-shaped structure according to the present invention. The insertion portion 21 of the buckling arm 2 are inserted into the buckling grooves 121 of the socket 1 and securely positioned with the gears 211 securing the insertion portion 21 of the buckling arm 2 within the buckling grooves 121 and preventing from slipping out. The frontal end of the circuit board 3 is obliquely inserted into the groove 11 of the socket 1 so that the contact elements 32 comes in contact with the row of signal contacts 111 of the socket 1. Then, using the groove 11 as an axis, the circuit board 3 is pressed downwardly, as a result, the edge of the circuit board 3 is pressed against the arch-shaped structure of resilient arm 22 pushing the resilient arms 22 on the sides outwardly and the circuit board 3 is inserted between the side of base plate 23 and positioning element 231. The side of base plate 23 secures the circuit board 3 by pressing against the sides of the circuit board 3. This condition does not break or make the resilient arms 22 lose its elasticity, the elastic property of the resilient arms 22 allows it to be deformed and extending on the side outwardly as the circuit board 3 is pushed over the arch-shaped structure 221 enabling the pad 2221 of resilient arm 22 that is clamped around the securing element 222 for securely buckling the indention portion 31 of the circuit board 3. In this condition, the securing element 222 is positioned against positioning element 231 of the base plate 23, and making the contact elements 32 of the circuit board 3 to come in electrical contact with signal contacts 111 inside of groove 11 (as shown in FIGS. 1 and 2) of the socket 1.

The electrical connector for attaching to a circuit board of the present invention has the following advantages and features compared to the conventional circuit board connector:

(1) The space between the side of base plate 23 and positioning element 231 allows the side of base plate 23 flexibly extend on the side outwardly without the risk of breaking or loss of elasticity when the circuit board 3 is pressed in between the resilient arms 22.

(2) The space between the side of base plate 23 and positioning element 231 allows the side of base plate 23 flexibly extend on the side outwardly without the risk of breaking or loss of elasticity and allows the pad 2221 of resilient arm 22 that is clamped around the securing element 222 to buckle the indention portion 31 of the circuit board 3, and the securing element 222 can be against the positioning element 231 of the base 23, to substantially secure the circuit board 3 and preventing the circuit board 3 from coming loose.

(3) The welding portion 232 which is bent inwardly at a bottom inner side of the base plate 23 of buckling arm 2, and a covering element 233 covering the welding portion 232 forms a gap. The welding portion 232 together with the covering element 233 limits the upward and downward movement of the circuit board 3 when the circuit board 3 is inserted into the groove 111 of the socket 1 and secured in between the resilient arms 2. The circuit board 3 can be maintained at a horizontal position with respect to the socket 1 to assure proper electrical connection between the signal contacts 111 of the socket 1 and the contact points 32 of the circuit board 3.

(4) The welding portion 232 together with the covering element 233 renders the support for the circuit board 3 strong and therefore they do not easy to break under the insertion of the circuit board 3.

While the invention has been described in conjunction with a specific best mode, it is to be understood that many alternatives, modifications, and variations will be apparent to those skilled in the art in light of the a foregoing description. Accordingly, it is intended to embrace all such alternatives, modifications, and variations which fall within the spirit and scope of the included claims. All matters set forth herein or shown in the accompanying drawings are to be interpreted in an illustrative and non-limiting sense.

What the invention claimed is:

1. An electrical connector for attaching a circuit board, comprising:

a socket made of insulative material, comprising a groove, a row of signal contacts disposed within the groove, and a buckling element disposed on two ends of the socket; and two buckling arms made from conductive material with each buckling arm detachably attached to each one of the buckling elements of the socket, each buckling arm comprising an insertion portion, a resilient arm including an arch-shaped structure and a base plate arm extending from the insertion portion of the buckling arm, with a securing element disposed at a bottom edge of the resilient arm, wherein a positioning element is disposed at a distal end of the base plate, and wherein a space is formed between the base plate and the positioning element so that the resilient arm moves flexibly outwardly towards the base plate; and a connecting end of a circuit board obliquely inserted into the groove of the socket and then pressed downwards against the arch-shaped structure of the resilient arm and securely held between the resilient arms of the buckling arms.

2. The electrical connector of claim 1, wherein each buckling element comprises a buckling groove on a groove side and positioned adjacent to the groove for receiving the insertion portion of the buckling arm.

3. The electrical connector of claim 1, wherein a bottom edge of the insertion portion of the buckling element comprises a plurality of gears for securely attaching the buckling arm within the buckling groove of the socket.

4. The electrical connector of claim 1, wherein a bottom edge of the base plate of the buckling arm comprises a welding portion bent inwardly, and said welding portion is fitted with a covering element forming a gap between said welding portion and the covering element, for supporting the circuit board.

5. The electrical connector of claim 1, wherein the arch-shaped structure of the buckling element serves for biasing inwardly.

6. The electrical connector of claim 1, wherein each resilient arm comprises a securing element extending downwardly, and wherein a pad clamps around two sides of said securing element for securing the circuit board.

* * * * *